US007175038B2

(12) United States Patent
Dolan

(10) Patent No.: US 7,175,038 B2
(45) Date of Patent: Feb. 13, 2007

(54) DEVICE FOR PREVENTING REMOVAL OF A LID

(75) Inventor: Denis William Dolan, Upper Coomera (AU)

(73) Assignee: Safe & Sound Bottles, Pty. Ltd., Nerang (AU)

( * ) Notice: Subject to any disclaimer, the term of this patent is extended or adjusted under 35 U.S.C. 154(b) by 0 days.

(21) Appl. No.: 10/257,341

(22) PCT Filed: Apr. 6, 2001

(86) PCT No.: PCT/AU01/00389

§ 371 (c)(1),
(2), (4) Date: Oct. 10, 2002

(87) PCT Pub. No.: WO01/76969

PCT Pub. Date: Oct. 18, 2001

(65) Prior Publication Data

US 2003/0075932 A1 Apr. 24, 2003

(30) Foreign Application Priority Data

Apr. 10, 2000 (AU) ..... PQ6763
Aug. 2, 2000 (AU) ..... 48990/00

(51) Int. Cl.
*A61J 1/00* (2006.01)

(52) U.S. Cl. ..... 215/206; 292/DIG. 2

(58) Field of Classification Search ..... 70/158, 70/160; 292/307 B, DIG. 2; 215/216–221, 215/223, 206

See application file for complete search history.

(56) References Cited

U.S. PATENT DOCUMENTS

| | | | | | |
|---|---|---|---|---|---|
| 3,405,828 | A | * | 10/1968 | Pierre | 215/9 |
| 3,407,954 | A | * | 10/1968 | Millis | |
| 3,684,117 | A | * | 8/1972 | Leopoldi | 215/9 |
| 3,779,412 | A | * | 12/1973 | Kirton | 215/225 |
| 3,782,577 | A | * | 1/1974 | Levey | 215/98 |
| 3,830,394 | A | * | 8/1974 | Lestaevel | 215/9 |
| 3,850,324 | A | * | 11/1974 | Meyer | 215/206 |
| 4,359,166 | A | | 11/1982 | Dubach | 215/272 |
| 4,796,768 | A | | 1/1989 | Stuckey | 215/207 |
| 5,085,332 | A | | 2/1992 | Gettig et al. | 215/249 |
| 5,269,429 | A | * | 12/1993 | Schumacher | 215/249 |
| 5,314,084 | A | * | 5/1994 | Folta | 215/249 |

(Continued)

FOREIGN PATENT DOCUMENTS

FR 2 329 535 5/1977

(Continued)

*Primary Examiner*—Gary Estremsky
(74) *Attorney, Agent, or Firm*—Madson & Austin, PC

(57) ABSTRACT

A device for preventing removal of a lid from a container. The device has a cover with a top which is adapted to fit over a lid of a container and an engagement means consisting of an upper continuous cylindrical wall and a lower section of integral and flexible leg segments. Each leg segment has a lateral portion or rib for engaging a neck part of the container to prevent removal of the cover from the container. Retaining means in the form of three independently rotatable locking rings prevent disengagement of the engagement means from the container. The deice is used on a typical drinking bottle with a screw on cap to prevent removal of the cap thereby maintaining hygiene and safety aspects of the liquid contents.

41 Claims, 3 Drawing Sheets

U.S. PATENT DOCUMENTS 5,431,293 A * 7/1995 Piron ..... 215/206
6,122,945 A * 9/2000 Grant ..... 70/426

FOREIGN PATENT DOCUMENTS

| | | |
|---|---|---|
| FR | 2586231 | 2/1987 |
| FR | 2684965 | 6/1993 |
| JP | 57 096962 | 6/1982 |
| WO | WO 97/17266 | 5/1997 |
| WO | WO99/16678 | 4/1999 |

* cited by examiner

DEVICE FOR PREVENTING REMOVAL OF A LID

FIELD OF THE INVENTION

The present invention relates to storage containers. It is particularly but not exclusively concerned with containers for liquids.

BACKGROUND OF THE INVENTION

A typical drinking container such as a bottle of soft drink has a screw on cap which allows easy access to the soft drink within the container. For hygiene and safety reasons various types of bottle closures have been proposed so as to prevent access to the interior of a container.

In a prior patent application no. WO99/16678, the applicant proposed a closure device for preventing easy removal of a lid from a container. The closure device required the neck of a container to be specially configured with spigots which coacted with locking rings in order to prevent removal of a cap which was located over the lid of the container.

The above closure device has the major drawback that it is necessary to make a container such as a bottle specifically so that it can coact with the locking device. This problem adds significantly to the cost of implementation of the general idea and thus makes it impractical for use.

A new type of device is now proposed which is able to prevent removal of a lid from a container or is able to prevent access to the interior of the container.

SUMMARY OF THE INVENTION

According to the present invention there is provided a device for a container, the device comprising a cover which is adapted to fit over an opening of a container, an engagement means for engaging part of the container to prevent removal of the cover from the container and a retaining means comprising a plurality of movable members which are adapted to be located around an external surface of the cover and which in a first mode of operation are lockable to prevent disengagement of the engagement means with part of the container and in a second mode of operation are movable to enable disengagement of the engagement means with part of the container.

It is understood that the word comprising is used in an inclusive sense and should not be interpreted to exclude any additional features.

Preferably the engagement means includes at least one engagement portion which is adapted to engage with a complimentary engagement portion of the container.

Preferably the engagement means includes at least one engagement portion which is adapted to engage with a lateral wall of the container.

The lateral wall of the container may include a peripheral rib, a peripheral protrusion, a collar, a recess in the wall of the container, or a part of an intermediate member which is able to fit onto a container so as to be retained thereon.

The engagement means may be adapted to engage with a stepped region in a peripheral surface of the container.

According to another embodiment the engagement means is adapted to engage with an intermediate member which is able to be fixed to the neck of a container.

The intermediate member may include more than one part such that when the parts are fitted together the intermediate member is unable to be lifted off the top of the container.

Preferably the intermediate device is able to engage with a lateral wall of the container.

The engagement means preferably comprises a lower portion of the cover.

The retaining means is preferably movable with respect to the cover and engagement means.

The engagement means may include one or more separate parts which connect together.

The engagement means may comprise at least two leg portions each with engagement portions which are adapted to engage underneath a lateral wall of the container.

The leg portions are preferably flexible.

The leg portions preferably have enough flexibility to permit the engagement portions to engage and disengage from a lateral wall of a container or an intermediate member.

The retaining means may be adapted to be able to prevent the leg portions from flexing apart so that their engagement portions can disengage from the container.

The retaining means may be adapted to squeeze the leg portions together so that the engagement means can engage a part of the container.

The engagement means preferably comprises a skirt portion extending downwardly from a top portion of the engagement means.

The cover preferably includes the engagement means.

The cover preferably comprises a top or cap which fits over a lid of a container.

The engagement means may comprise a lower flexible portion of the cap.

The cap is preferably shaped to match the shape of the neck of the container it is adapted to cover.

The engagement means preferably comprises inner peripheral rib portions which are adapted to engage underneath an external collar/rib portion of the container.

Each leg portion may be separated from an adjacent leg portion by a slot.

The slot may be vertical or parallel to the longitudinal axis of the cover.

The leg portions in a relaxed mode of operation are preferably able to disengage from the container engagement portion.

The leg portions in a flexed mode of operation are preferably adapted to engage the engagement portion of the container.

The engagement means may include a removable engagement part which is adapted to engage with an engagement portion(s) of the cover to retain the cover over the container.

The removable elongate portion preferably enables the cover to be removably placed over the lid and neck of the container without flexing of the engagement portion(s).

The engagement means may include coupling portion(s) for coacting with the retaining means to retain the engagement means in engagement with part of the container.

The retaining means preferably comprises a coupling which is located around the cover.

The retainer preferably can slide along the cover.

The retainer may be adapted to coact with the coupling portion to prevent the engagement means from disengaging with the container engagement means.

Preferably the retaining means comprises a plurality of rotatable members.

Preferably each rotatable member is independently rotatable.

Each rotatable member may be coupled to an adjacent rotatable member.

Each rotatable member preferably comprises coupling means for coupling with coupling portion(s).

Alternatively each retaining means comprises coupling means for coupling with coupling means of the engagement means.

It is preferred that when the coupling means of the rotatable members is coupled with the coupling means of the engagement means, the retainer is prevented from movement parallel to the longitudinal axis of the cover.

According to an alternative embodiment the retainer is prevented from sliding movement along the outside peripheral surface of the cover.

The coupling means preferably comprises one or more recesses on an inner peripheral surface of each rotatable member.

Each rotatable member preferably comprises a ring member.

The coupling means of the engagement means preferably comprises a plurality of peripheral protrusions, each peripheral protrusion able to fit into one or more recesses of the rotatable member.

Each rotatable member may comprise an inner peripheral guide for receipt of a peripheral protrusion.

The peripheral guide is preferably an annular slot.

The peripheral guide may be an inner circumferential groove.

The recess may have the same depth as the depth of the groove.

Each rotatable member preferably has an inner circumferential rib with one or more recesses therein.

Each peripheral protrusion preferably is able to fit under the rib.

According to one embodiment there are a plurality of ribs on each ring.

It is preferred that each ring has two parallel ribs with a groove defined therebetween.

The cover may have a head section having a closed top and side wall to cover the lid of the container.

The cover preferably includes a tail section including a plurality of leg segments or leg portions.

Each leg segment preferably extends downwardly from the closed side wall of the head section.

Each leg segment preferably includes axially aligned protrusions on its outer surface.

Each leg segment preferably includes a peripheral collar segment which forms part of the engagement means.

The retainer preferably covers the length of the leg segments to conceal the axially aligned protrusions.

The retainer is preferably limited to movement between end portions of the cover.

The end portions preferably comprise ribs, protuberances or other stops for preventing the retainer from being removed from the cover.

The end portions are preferably located at both extremities of the cover.

The rings are preferably connected together in a manner whereby they are able to rotate with respect to each other.

Each ring preferably includes an inner annular wall which is adapted to engage with an adjacent annular wall of an adjacent ring.

Adjacent rings are preferably coupled together by coupling means.

Each of the rings are preferably formed with a discontinuity to enable the rings to be located over the cover, whereby the ends of the rings are connected together to close the discontinuity and retain the rings on the cover.

BRIEF DESCRIPTION OF THE DRAWINGS

A preferred embodiment of the present invention will now be described by way of example only with reference to the accompanying drawings in which.

DETAILED DESCRIPTION OF THE DRAWINGS

Figure 1:
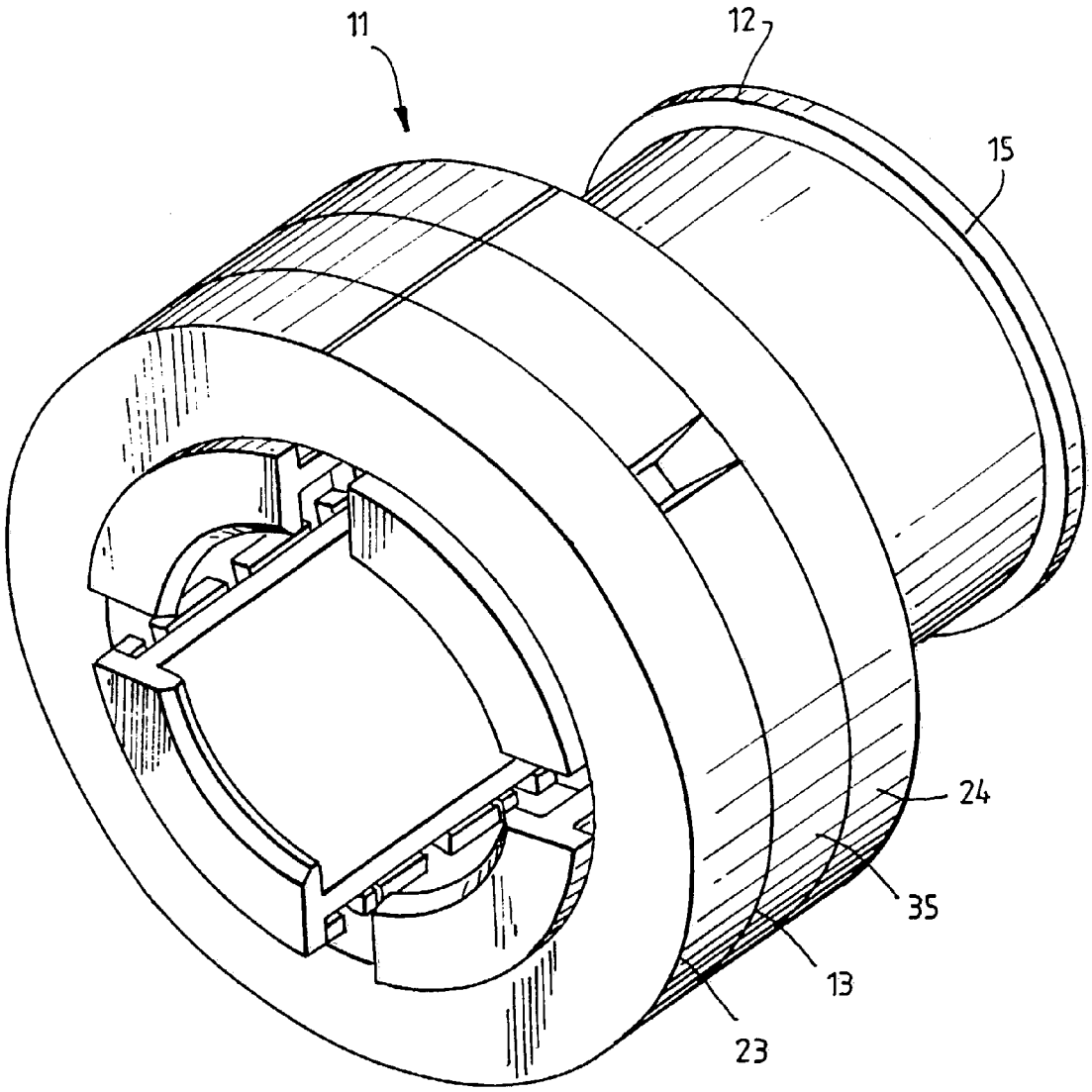
FIG. 1 shows an angled view of a device according to the present invention.

As shown in FIG. 1 a device 11 for preventing removal of a lid of a container according to the preferred embodiment consists of a top 12 and three locking rings 13.

Figure 2:
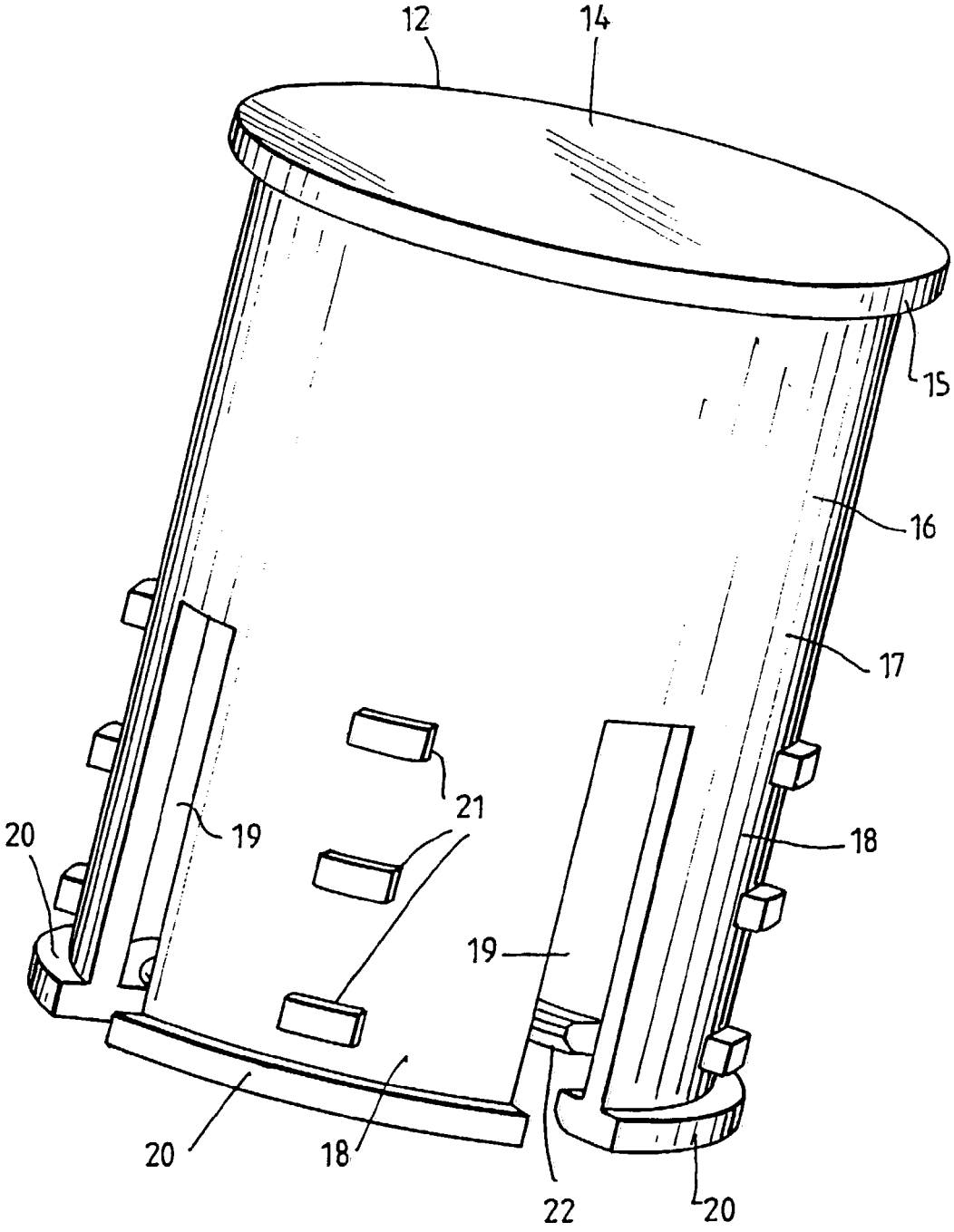
FIG. 2 shows an angled view of the device shown in FIG. 1.
Figure 3:
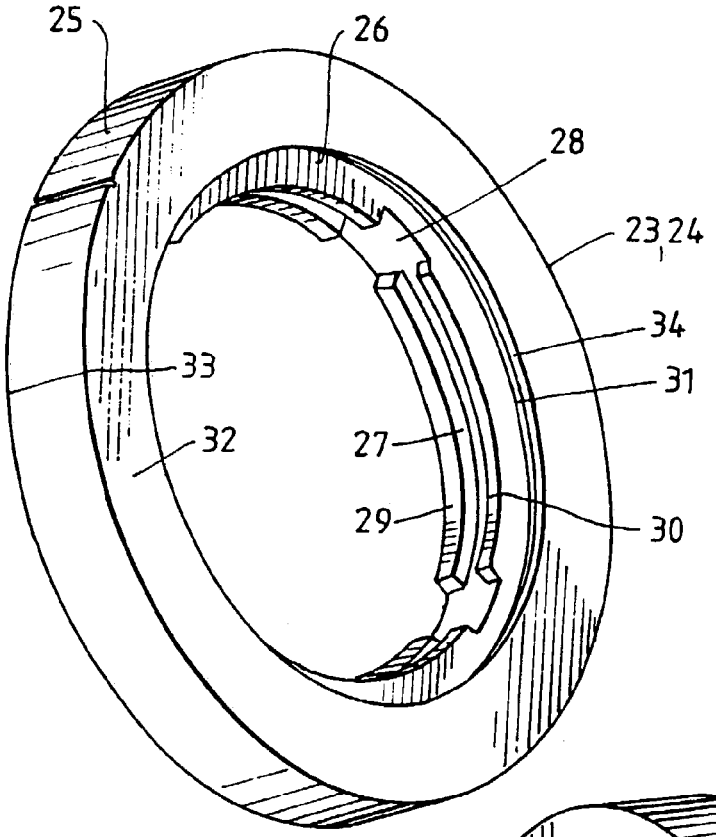
FIG. 3 shows an angled view of first and third rings of the device.
Figure 4:
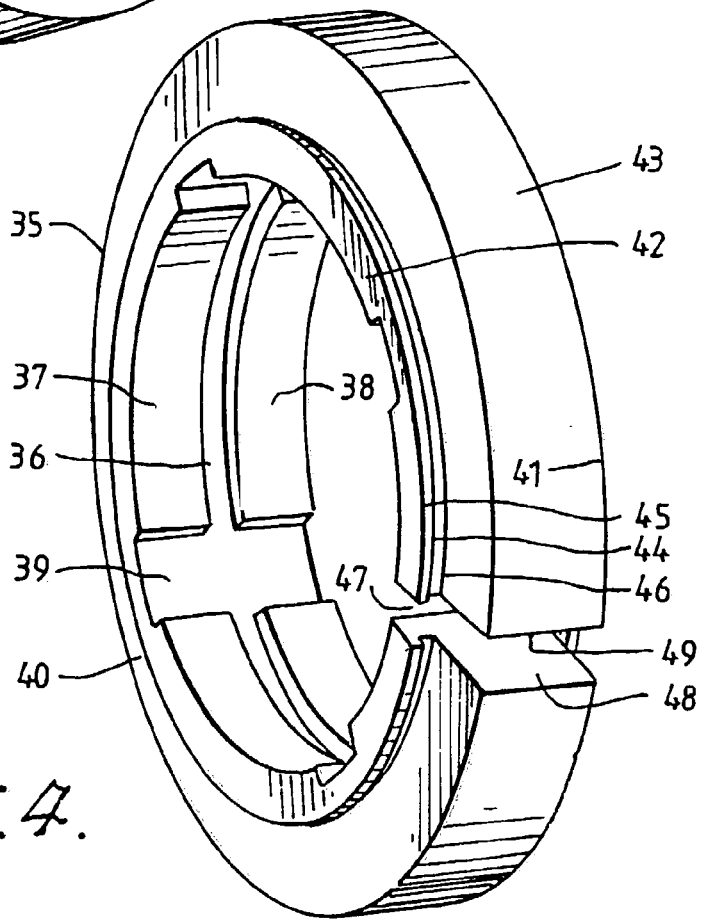
FIG. 4 shows an angled view of the central ring.

The top 12 is shown in more detail in FIG. 2 and the locking rings 13 which are retained around the top 12 are shown in greater detail in FIGS. 3 and 4.

The top 12 is generally cylindrical in shape and has a top circular face 14 with a circumferential rim 15 which extends slightly beyond the level of the body of the top 16 to form an end flange.

In this embodiment the top is approximately 5 cm in length and 2½ cm in diameter.

The body section 16 can be divided into two subsections. The first subsection is directly below the top face 14 and consists of a continuous cylindrical wall 17.

The lowermost section 18 consists of four curved leg segments which are integrally formed with the upper section 17 and extend downwardly and coaxially with the upper section 17 and with each of the other leg segments 18.

Each of the leg segments 18 are separated by a slot 19 which extends downwardly axially from the middle section 17.

Each of the slots 19 are equispaced around the mid section 16 and adjacent slots 19 define a leg segment 18 therebetween.

According to one embodiment the leg segments 18 can simply be formed by providing vertical/axial slots in the wall of a cylindrical closed tube.

The lower end of each leg segment 18 is formed with a lateral lip or rib segment 20. Each rib 20 extends outwardly at right angles to the external surface of the mid section 16.

Each leg segment 18 is also provided with rectangular lugs 21 which are vertically/axially aligned along a mid point of each leg segment 18.

In this embodiment three lugs 21 are provided and these lugs 21 are slightly narrower in radial length than the radial length/width of the ribs 20.

Each of the leg segments 18 has a degree of flexibility which allows a degree of radial flexibility which permits them to move slightly inwardly and slightly outwardly.

The lower end of each leg segment 18 is also provided with an internal rib 22 which is virtually identical to the external rib 20 although this is not essential.

The first and third rings of the locking rings are represented by items 23 and 24 in FIG. 1. They each consist of a cylindrical element having a generally smooth external circumferential surface 25 having a diameter which is greater than the external diameter of the middle section 16 of the top 12.

The width of each of the rings is approximately 1 cm.

The inner peripheral surface 26 of rings 23 and 24 consist of a circumferential groove 27 which is interrupted by four equispaced recesses 28.

The groove 27 is defined by inner peripheral upper and lower ribs 29, 30. The ribs 29, 30 and groove 27 extend around the whole of the inner peripheral surface of the ring 23, 24 with the recesses 28 effectively cutting away the ribs 29 and 30.

The recesses 28 effectively provide an entry point for a protrusion to fit into the groove 27.

In this embodiment each of the rings 23, 24 also has an additional internal peripheral circumferential groove with the depth of the groove being deeper than that of the groove 27. This engagement groove 31 is located close to one of the end wall surfaces 32, 33 so that a thin inner peripheral rib 34 is formed as one of the walls of the groove 31.

The groove 31 and lip 34 are adapted to engage with correspondingly shaped ribs and grooves of the centre ring shown in FIG. 4.

It should be noted that because this embodiment describes three rings the two external rings 23 and 24 only need to have one engagement groove in order to form a complete coupled set of rings. However if there were more rings the outside rings would end up being similar to rings 23 and 24 and each of the inside rings would have coupling grooves on upper and lower surfaces as will now be described in relation to FIG. 4.

Thus ring 35 in a similar fashion to rings 23 and 24 has a similar overall shape with an inner peripheral surface having a centrally located inner peripheral groove 36 defined by relatively wide inner peripheral ribs 37, 38.

Although ribs 37 and 38 are wider than those of rings 23 and 24 the width of the groove 36 is essentially the same as that for both the rings 23 and 24.

In a similar fashion recesses 39 are provided at equispaced locations perpendicular to the direction of the groove 26 and these recesses 39 extend between the upper and lower faces 40, 41 of ring 35.

The ring 35 is also provided with upper and lower annular stepped regions 42 having a smaller radial diameter and width than the overall diameter and width of the outermost peripheral surface 43.

The stepped surface 42 is provided with an outer peripheral groove 44 which is formed between a peripheral collar 45 and the opposing surface of either the top or bottom face of the ring 35, namely surface 46.

The collar 45 is adapted to fit into recess 31 of rings 23 and 24 and likewise the rib 34 of rings 23 and 24 is adapted to fit into the groove 44 of ring 35.

The ring 35 is also shown with a gap 46 creating a discontinuity between ends 48 and 49.

Ring 35 is preferably made of a resilient material which allows a degree of flexibility so that ends 48 and 49 can be squeezed together.

When ends 48 and 49 are squeezed together the diameter of ring 35 reduces and it is then possible to couple rings 23 and 24 to upper and lower faces of the ring 35.

Once rings 23 and 24 are coupled to ring 35 they are able to rotate independently of ring 35.

To use the device it is important that the coupled rings 23, 24 and 35 are located around the periphery of top 12 between rim 15 and rib segments 20.

This is preferably achieved by providing an axial cut through rings 23 and 24 and then joining the ends of these rings once all three rings are located over the top 12.

The coupled rings 23, 24 and 35 are then able to slide up and down the top 12 within the boundaries defined by rib 15 and rib segments 20.

In use the device 12 is adapted to be placed over a bottle having a screw-on cap. The coupled rings 23, 24 and 35 are adapted to be slid upwardly so that ring 24 abuts rim 15.

The leg segments are then able to flex apart as the top 12 is placed over the top of the lid of the container.

The rib segments 20 of the leg segments 18 are then able to slide over a collar around a neck region of the bottle and engage underneath this collar.

In doing so the leg segments 18 flex initially outwardly and then inwardly as engagement occurs between the internal ribs 22 and the collar of the bottle.

The rings 23, 24 and 35 are then slid downwardly but each of the rings are firstly aligned so that they are able to slide over the lugs 21.

This is permissible because the ribs 21 are able to fit into the recesses 28 and 39 of the rings 23, 24 and 35.

The embodiment shown has a simple arrangement of lugs 21 which makes it easier to understand the operation of the invention. However it is. anticipated that more complex arrangements of lugs be provided along with additional rings having a predetermined array of recesses.

As shown in FIG. 1 the coupled rings will be able to slide down to the bottom of the top 12 so that they abut the upper surface of rib segments 20.

Because the inside diameter of each of the rings is only slightly larger than the external diameter of the middle section 16, downward movement of the rings forces the leg segments 18 to move together so that they are effectively of the same external diameter as the upper section 17.

At the same time the internal ribs 22 are in engagement with the collar of the bottle.

Once the lower ring is in abutment with the external rib segments 22 all the rings can be turned so that the lugs 21 slide within their respective grooves. When this occurs the rings can no longer be moved upwardly.

As long as one of the lugs is located within one of the grooves of the rings it is impossible to move any of the rings upwardly.

As long as the rings are located over the leg segments 18 it is not possible to move the leg segments outwardly to disengage the internal ribs 22 from the collar of the bottle.

Accordingly it is not possible to access the lid of the bottle and therefore unscrew it from the top of the bottle.

It envisaged that different devices of the type described are provided with different combinations of lugs and recesses so that in effect a combination lock is provided which only the owner of the device will know the combination of. It follows therefore that unauthorised removal of the lid of the bottle is not possible unless the combination of the locking assembly of lugs and recesses is known in advance.

It is important to note that the embodiment described above can be modified to improve the ease of implementation of the inventive concept. This may involve making it simpler to couple the rings together as well as making it simpler to place the rings over the mid section 16 of the top 12.

Likewise it is possible that the flexible leg segment arrangement could be replaced by interfitting components together so that they engage a collar of a bottle and then covering these engaging components by the coupling rings so that the coupled components cannot be uncoupled.

It is also possible that an intermediate component be provided which is able to engage a collar of a bottle or other container and that this intermediate component be provided with an engagement wall or surface or other means by which the device can be coupled to it.

The invention claimed is:

1. A device for a container, the device comprising a cover including a tubular portion which fits over an opening of the container, an engagement means including at least one resiliently flexible engagement member and a retaining means comprising a plurality of movable members which are locatable around an external surface of the cover and wherein in a first mode of operation the cover is prevented from removal when the engagement member engages part of the container and the movable members are moved to a position where they are located adjacent to the engagement member in a radial direction and cover the engagement member to prevent outward movement of the engagement member and in a second mode of operation the movable members are rotated to an unlocking position whereby the engagement member is able to move outwardly to disengage from the part of the container to enable the cover to be removed.

2. The device as claimed in claim 1 wherein the engagement means includes a plurality of engagement members.

3. The device as claimed in claim 2 wherein each engagement member comprises a leg portion with an engagement portion which is configured to engage with a lateral wall of a container.

4. The device as claimed in claim 3 wherein each leg portion is integrally formed with an upper section of the engagement means and extends downwardly and coaxially with the upper section and with each of the other leg portions.

5. The device as claimed in claim 2 wherein the engagement members are configured to flex apart as the cover is placed over the top of the container.

6. The device as claimed in claim 2 wherein the engagement members are configured to initially flex outwardly and then inwardly as engagement occurs between the engagement portions and the lateral wall of the container.

7. The device as claimed in claim 1 wherein the retaining means is configured to prevent the engagement members from flexing apart in the first mode of operation.

8. The device as claimed in claim 1 comprising coupling portions which extend outwardly from an outer surface of part of the device for coupling with the retaining means.

9. The device as claimed in claim 8 wherein the coupling portions extend outwardly from an outer surface of the cover.

10. The device as claimed in claim 9 wherein the coupling portions are arranged around the periphery of the outer surface.

11. The device as claimed in claim 10 wherein the outer surface is located below a top end of the cover.

12. The device as claimed in claim 11 wherein the cover includes a top surface which is configured to be located above the opening to the container when the device is located over the container.

13. The device as claimed in claim 12 wherein the cover incorporates the engagement means at a lower end thereof.

14. The device as claimed in claim 1 wherein the cover includes a lower section including a plurality of leg segments.

15. The device as claimed in claim 14 wherein each leg segment extends downwardly from a tubular section of the cover.

16. The device as claimed in claim 15 wherein each leg segment includes protrusions on its outer surface, which protrusions act as the coupling portions.

17. The device as claimed in claim 16 wherein each leg segment includes an inwardly directed peripheral collar segment which forms part of the engagement means.

18. The device as claimed in claim 17 wherein the cover incorporates end portions which are configured to retain the movable members there between.

19. The device as claimed in claim 18 wherein the engagement means includes one or more separate parts which connect together.

20. The device as claimed in claim 1 wherein the engagement means comprises at least two leg portions each with engagement portions which are configured to engage underneath a lateral wall of the container.

21. The device as claimed in claim 20 wherein the retaining means is configured to be able to prevent the leg portions from flexing apart so that their engagement portions can disengage from the container.

22. The device as claimed in claim 21 wherein the retaining means is configured to squeeze the leg portions together so that the engagement means can engage part of the container.

23. The device as claimed in claim 22 wherein the cover includes coupling portions for co-acting with the retaining means to retain the engagement means in engagement with part of the container.

24. The device as claimed in claim 1 wherein the movable members are rotatable about the external surface of the cover.

25. The device as claimed in claim 24 wherein each member is independently rotatable.

26. The device as claimed in claim 25 wherein each movable member is coupled to an adjacent movable member.

27. The device as claimed in claim 26 wherein each movable member comprises coupling means for coupling with the coupling portions.

28. The device as claimed in claim 27 wherein when the coupling means of the movable members are coupled with the coupling portions, the movable members are prevented from movement between the end portions of the cover.

29. The device as claimed in claim 28 wherein the coupling means comprises one or more recesses on an inner peripheral surface of each movable member.

30. A device for a container, the device comprising a cover including a tubular portion which fits over a lid of the container, an engagement means for engaging part of the container to prevent removal of the cover from the container and a retaining means comprising a plurality of movable members and wherein in a first mode of operation the cover is prevented from removal when the engagement means engages part of the container and the movable members are moved to a position where they are located adjacent in a radial direction and cover the engagement means to prevent outward movement of the engagement means and in a second mode of operation the movable members are rotated to an unlocking position whereby the engagement means is able to move outwardly to disengage from the part of the container to enable the cover to be removed.

31. The device as claimed in claim 30 comprising coupling portions which extend outward from an outer surface of part of the device for coupling with the retaining means.

32. The device as claimed in claim 31 wherein the coupling portions extend outwardly from an outer surface of the cover.

33. The device as claimed in claim 32 wherein the coupling portions are arranged around the periphery of the outer surface.

34. The device as claimed in claim 33 wherein the outer surface is located below a top end of the cover.

35. The device as claimed in claim 30 wherein the cover includes a top surface which is configured to be located above the lid when the device is located over the container.

36. The device as claimed in claim 30 wherein the engagement means includes a plurality of engagement members.

37. The device as claimed in claim 36 wherein each engagement member comprises a leg portion with an engagement portion which is configured to engage with a lateral wall of a container.

38. The device as claimed in claim 30 wherein the retaining means is configured to prevent the engagement members from flexing apart in the first mode of operation.

39. The device as claimed in claim 36 wherein the engagement members are configured to flex apart as the cover is placed over the top of the container.

40. The device as claimed in claim 37 wherein the engagement members are configured to initially flex outwardly and then inwardly as engagement occurs between the engagement portions and the lateral wall of the container.

41. The device as claimed in claim 30 wherein the engagement means includes a removable engagement part which is configured to engage with an engagement portion of the cover to retain the cover over the container.

* * * * *